United States Patent [19]

Cogswell et al.

[11] Patent Number: 4,795,416

[45] Date of Patent: Jan. 3, 1989

[54] APPARATUS FOR C-FOLDING PAPER WITH VARIABLE SPACING

[75] Inventors: John Cogswell, Maynard; Robert Fokos, Wayland, both of Mass.

[73] Assignee: Sequa Corporation, New York, N.Y.

[21] Appl. No.: 112,293

[22] Filed: Oct. 26, 1987

Related U.S. Application Data

[63] Continuation-in-part of Ser. No. 835,956, Mar. 4, 1986, Pat. No. 4,721,504, which is a continuation of Ser. No. 497,642, May 24, 1983, Pat. No. 4,588,393.

[51] Int. Cl.[4] ..... B65H 45/22

[52] U.S. Cl. ..... 493/423; 493/442; 493/441; 493/478

[58] Field of Search ..... 493/416, 417, 422, 423, 493/438, 441, 476, 178, 179, 478, 479

[56] References Cited

U.S. PATENT DOCUMENTS 4,588,393 5/1986 Cogswell et al. ..... 493/440

4,614,512 9/1986 Capdeboscq ..... 493/441

4,701,156 10/1987 Larsonneur ..... 493/418

4,721,504 1/1988 Cogswell et al. ..... 493/440

*Primary Examiner*—Robert P. Olszewski

*Assistant Examiner*—Jack Lavinder

*Attorney, Agent, or Firm*—Mitchell D. Bittman

[57] ABSTRACT

A paper product traverses a straight line path through a folding apparatus defined by two folding stations that are mounted independently of one another. Each station includes supports, a central frame extending along the paper folding path, and belt arrangements for gripping, propelling and folding a laterally projecting portion of the paper. Each station is mounted for a lateral translation of the entire station perpendicular to the paper path. In the preferred form, this translation is accomplished with racks associated with each stand and pinions carried on a common drive shaft that engage the racks. Both stations also preferably include an arrangement for rotating the station as a whole in the horizontal plane to adjust the squareness of the fold.

7 Claims, 5 Drawing Sheets

APPARATUS FOR C-FOLDING PAPER WITH VARIABLE SPACING

REFERENCE TO RELATED APPLICATIONS

This application is a continuation-in-part of application U.S. Ser. No. 835,956 filed Mar. 4, 1986 now U.S. Pat. No. 4,721,504, which is a continuation of U.S. Ser. No. 497,642 filed May 24, 1983, now U.S. Pat. No. 4,588,398.

BACKGROUND OF THE INVENTION

This invention relates in general to folding apparatus for paper products, and more specifically to a high speed folder which can fold the product along two parallel lines (a "C" or "delta" fold) with the capability of adjusting the distance between the fold lines.

Automatic folding machines are used both in binderies to produce printed publications and in industries where it is necessary to fold cardboard. In cardboard folding, it is common to use blanks that are pre-creased along the intended fold line. Also, there is usually no concern with whether the folding operation smears printed ink on the cardboard. With paper folding, there is normally no pre-crease, the paper may be recently printed so that the ink has not set, and because of the flexibility of the paper, it is much more difficult to control, particularly at high speeds, than cardboard.

An important use for paper folding machines is in the production of envelope "inserts" for direct mail marketing. Common paper folding machines that operate on or off press, however, operating at speeds that are relatively slow compared to the line speed of the printing press. The folding process is therefore often a limiting factor on the efficiency of the entire printing and finishing process. Currently off press finishing of inserts is most common. Typical speeds for such off press folding machines are 5,000–7,000 pieces per hour.

Usually in known folding machines, folds are made by mechanical means and twisted belts that engage the paper. In other paper folding machines, and in many cardboard folding machines, the fold is made by driving the paper against a stationary forming member. In either case, significant problems heretofore have been that these machines are relatively slow, and there is sliding contacts between the paper and components of the machine that engage the paper. This sliding contact is very undesirable for printed paper products because it tends to mark the printed surface. This is a particularly difficult problem if the printed matter is fed directly from a printing press and the ink may not have fully dried. Thus, known folding machines are not suited for integration with the printing apparatus so that the folding can be accomplished as the material is printed and leaves the press.

Besides having a high throughput rate and an avoidance of smearing the printed material, a commercially acceptable folding machine should fold a product either in half or, for letter size inserts, in thirds (a C or delta fold) If it folds the product twice ideally it should do so without using two machines or running the same product through the same machine twice. In known folding machines, for example, it is usually necessary to double run a letter size product. A commercially acceptable folding machine should also operate reliably, maintain a proper alignment of the paper product during the folding, and accept a variety of product sizes and thicknesses, including multiple ply papers that have already been folded at least once.

Applicants' U.S. Pat. No. 4,588,393 describes an apparatus and method for the high-speed folding off freshly printed paper products that are not pre-creased. However, in the '393 apparatus the folding occurs at fixed locations. The apparatus therefore cannot vary the locations of the fold for products of the same size or accommodate significant variations in the size of the paper products being folded. To date, applicants are not aware of any paper folding machine which can produce a double running C-fold and can vary the spacing between the fold lines.

Because the inherent susceptibility of such an apparatus to paper jams due, at least in part, to misalignments of the paper products being processed, it is important to align the paper while it traverses the apparatus to produce a fold or folds that are "square", that is, where the edges of the folded paper align with one another. To control alignment, the '393 apparatus also discloses an arrangement for adjusting the skew of the product as it is fed, a pair of manually adjustable rip rollers located at the sides of the product as it enters the apparatus. In practice, however, It has proven difficult to make and maintain the correct degree of adjustment during operation. Also, the '393 apparatus is organized about a continuous central frame that acts as a primary guide for the alignment of the various assemblies of the apparatus, and therefore the alignment of the high speed (up to 50,000–60,000 pieces per hour) stream of products in the apparatus. As noted above, While this construction produces a Workable level of alignment, it does so With the restriction that the location of the folds is fixed It is therefore a principal object of the invention to provide a folding apparatus for paper products, including folded paper sheet products ("signatures"), particularly a high speed folder for printed products, which can C-fold the products at two parallel fold lines with a variable spacing between the fold lines.

Another principal object is to provide a folding apparatus with the foregoing advantages that can readily and reliably adjust the angular orientation of the fold line with respect to the product.

A further object is to provide a folding apparatus formed of a line of several self-contained units to provide interchangeability of components, and flexibility in sequencing of operations.

Yet another object is to provide a folding apparatus with the foregoing advantages which is comparatively mechanically simple, is readily adjusted, and has a favorable cost of manufacture as compared to conventional paper folding machines.

SUMMARY OF THE INVENTION

A high speed folding apparatus that can make one or two "cross" folds in a paper product that is not pre-creased, and is typically printed, is formed from two folding stations arrayed in line with one another to define a linear paper movement path through the apparatus. Each station is independently mounted with respect to ground and is capable of folding a laterally projecting portion of the paper product through a 180° rotation about a predetermined and adjustable location on the paper. The mounting includes a mechanical system for translating one entire station laterally with respect to the other. In a preferred form the station has two upright support stands that are guided to slide perpendicular to the product path, a common drive shaft that mounts gears that engage racks associated with each stand, and a drive mechanism to rotate the shaft to affect the translation. The mounting also includes a mechanism for pivoting each station in a horizontal plane. In a preferred form the station is rotated about a fixed pivot pin at one end and is adjusted by a screw and threaded follower block combination.

These and other features and objects of the invention will be more readily understood from the following detailed description which should be read in light of the accompanying drawings.

DETAILED DESCRIPTION OF THE PREFERRED EMBODIMENT

Figure 1:
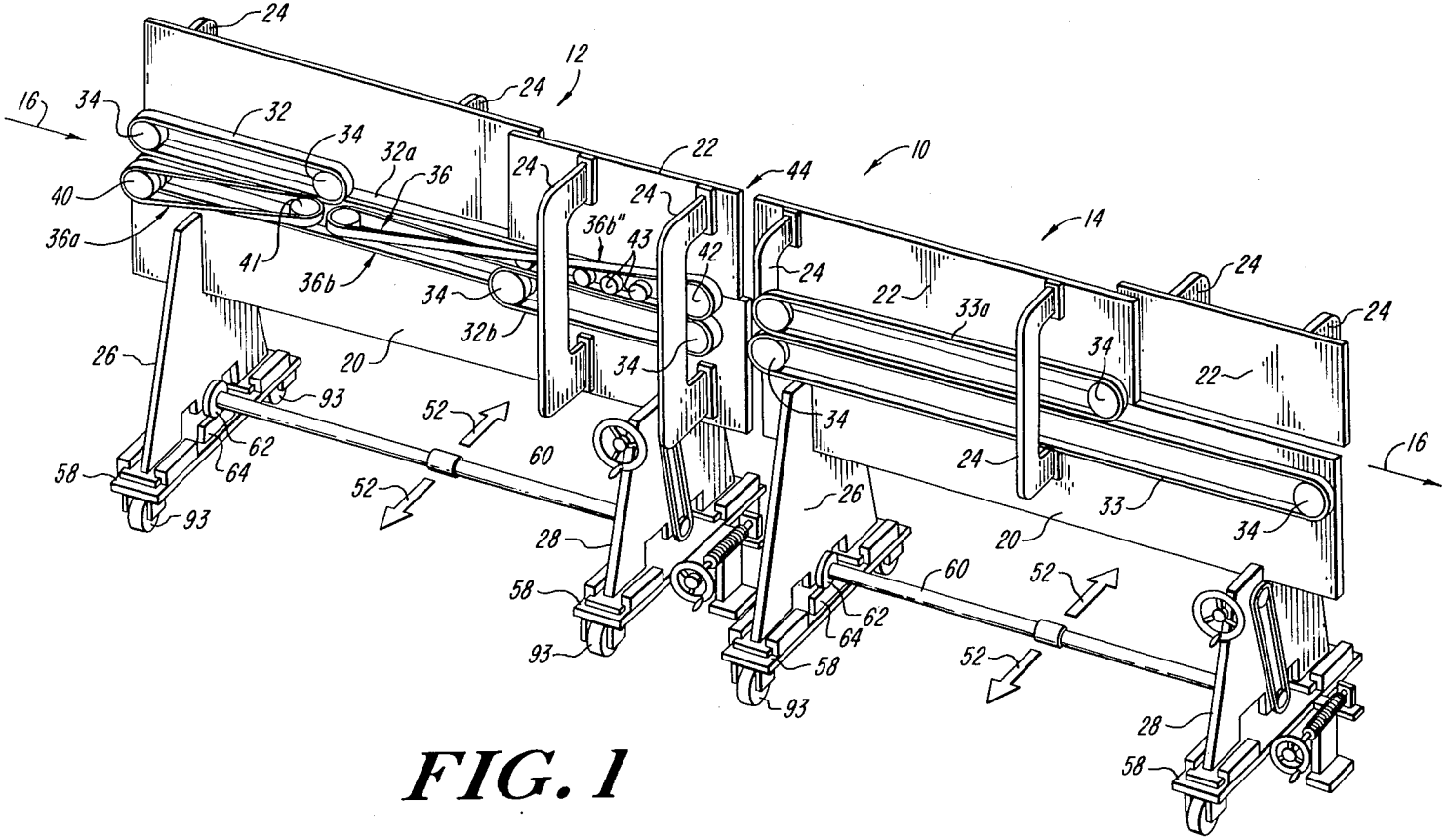
FIG. 1 is a simplified view in perspective of a paper folding apparatus according to the present invention utilizing two independent folding stations arrayed end-to-end to define a single, linear product flow path.
Figure 2:
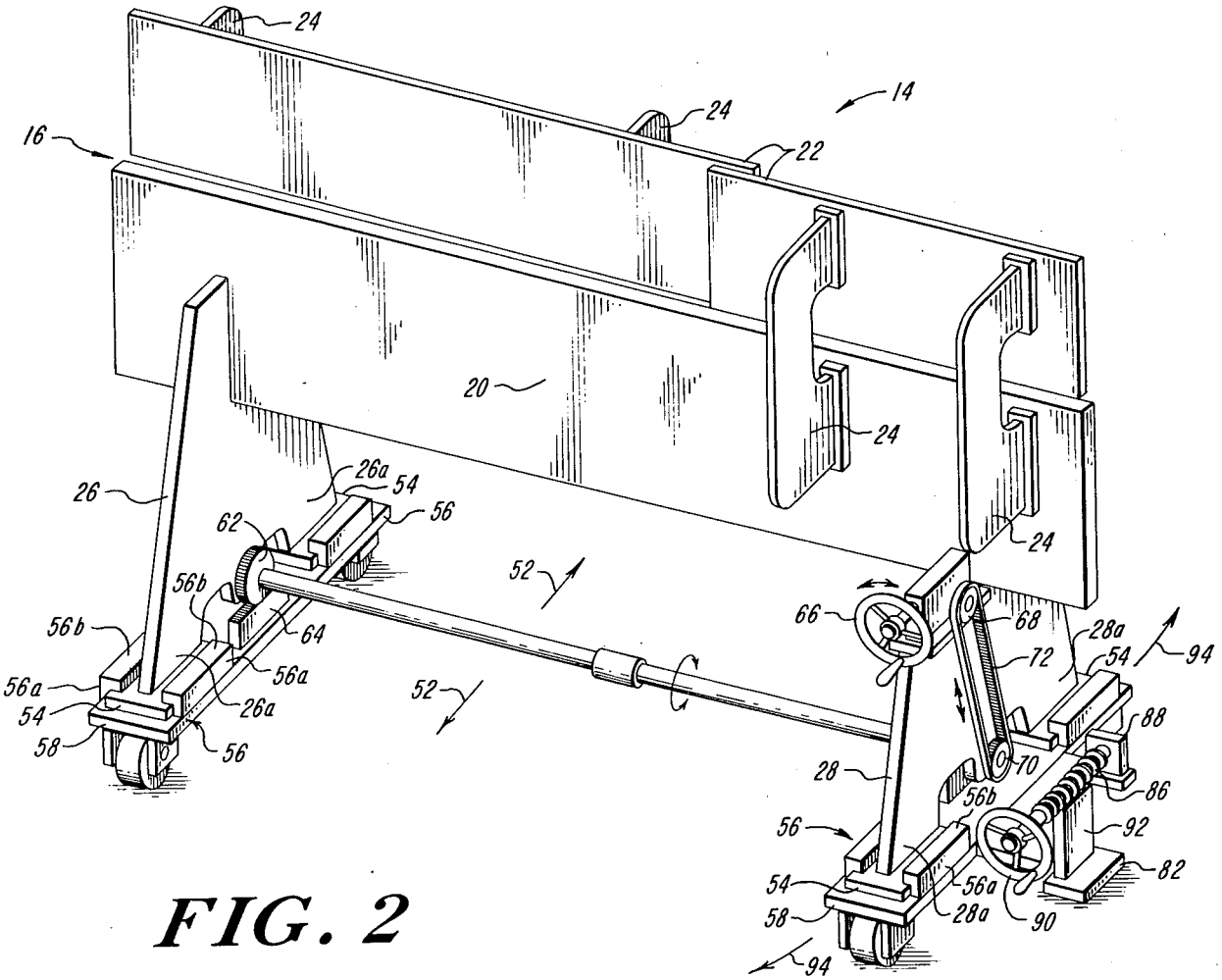
FIG. 2 is a bore detailed view in perspective of one of the folding station shown in FIG. 1.
Figure 3:
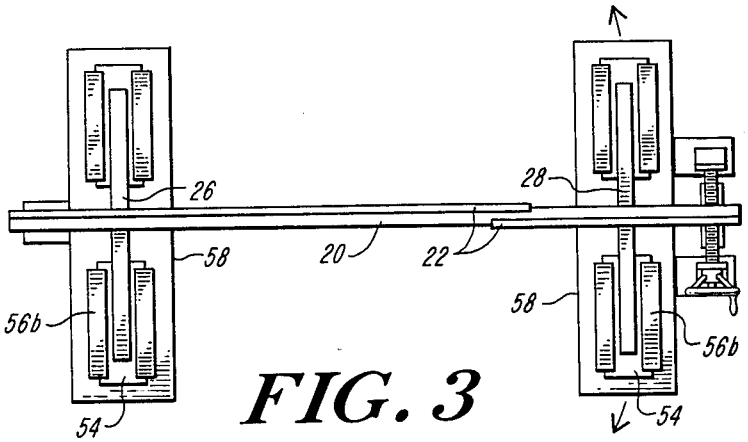
FIG. 3 is a simplified top plan view of the apparatus shown in FIG. 2.
Figure 4:
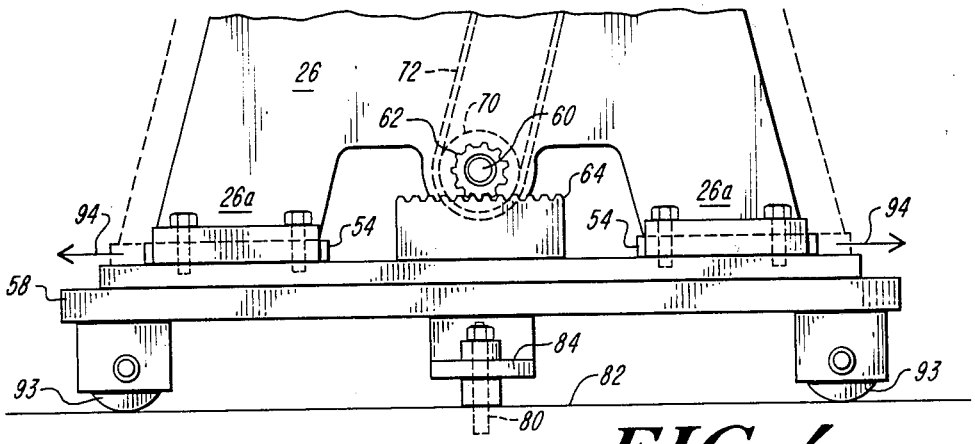
FIG. 4 is a detailed view in side elevation of the lower end of one station taken along the line 4—4 of FIG. 3.
Figure 5:
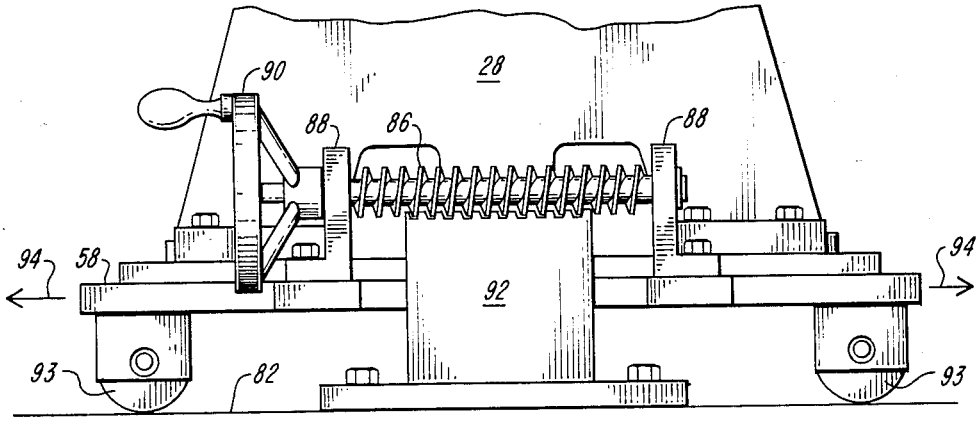
FIG. 5 is a view corresponding to FIG. 4 of the opposite end of the same station.
Figure 6:
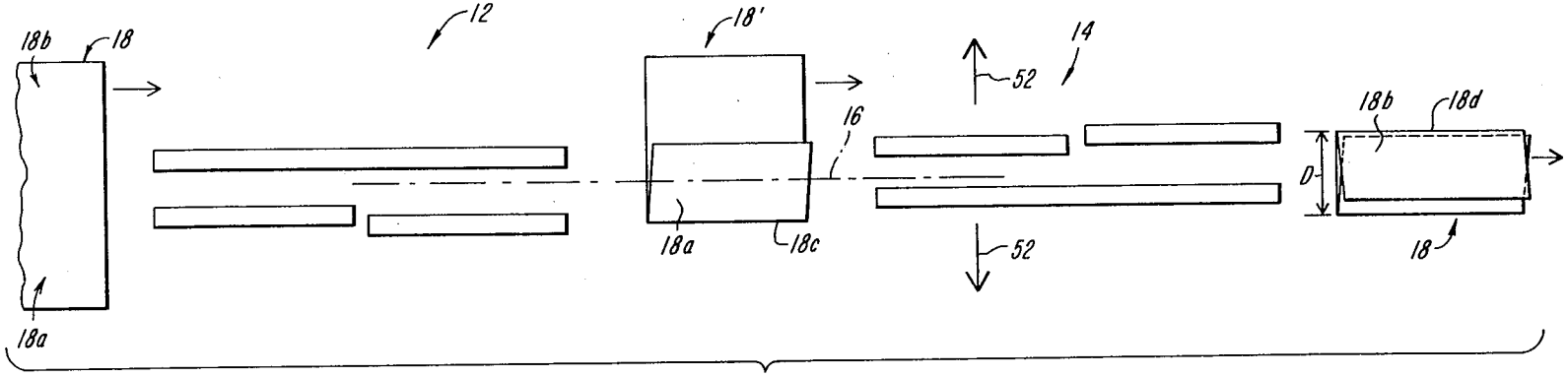
FIG. 6 is a top plan view illustrating the interaction of the folding belts of the apparatus shown in FIG. 1 with a sheet paper product as it passes through the apparatus and is folded along two parallel lines.

FIG. 1 shows a high speed folding apparatus 10 formed from two folding stations 12 and 14 that are aligned end-to-end to define a straight line folding path 16 for a sheet paper product 18 (FIG. 6). The paper product may be a single sheet of paper, or a "signature," that is, a paper product which has been previously folded. The paper product is typically printed. The speed of operation of the apparatus 10 can be as high as 50,000 to 60,000 products per hour, which is sufficiently fast to allow the apparatus 10 to receive a stream of products 18 "on line" directly from a printing press. This avoids stacking the products and then transporting and feeding them through a separate folding operation, which typically in the prior art occurs after the printed matter had dried sufficiently to avoid smearing the ink. The apparatus 10 can also be used off-line, usually after a sufficient time delay to allow "cold-set" ink printed products to set.

The construction and operation of the folding stations 12 and 14 utilize the operating principles and construction features described in applicants' U.S. Pat. No. 4,588,393, the disclosure of which is incorporated herein by reference. Each folding station includes a "spine-like" pair of frame members 20,22 that are mutually spaced vertically from one another a the flow path 16. Generally C-shaped supports 24 secure the members 22,24 with this gap to allow the free movement of the products along the path. The members 20,22 are supported on a pair of stands 26,28.

As described in the aforementioned U.S. Pat. No. 4,588,393, and shown herein in FIGS. 1 and 7, the products are gripped and carried through the apparatus 10 by a folding mechanism 30 that includes opposed pairs of gripping belts **32*a*,32*b*,33 and 33*a*, all associated with an upstream station 12, and mirror image gripping belts 82,32*a*,32*b*,33 and 33*a*, associated with the downstream station 14. Pulleys 34 carry these gripping belts. Idler pulleys (not shown) engage a groove in the rear surface of the gripping belts to control the lateral location of the belts With a high degree of accuracy. The mating surfaces of the belt are generally flat and are adapted to grip and carry the products therebetween. At least one edge of the belts, typically the running edge defined by a mating pair of the belts, defines the location of the fold without the need for precreasing of the paper product. Because this reference edge is moving at the same speed as the paper products gripped between the belts, there is substantially no relative motion between the product and the belts. As a result even freshly printed products can be gripped and carried with considerably less marking of the products than with conventional folding apparatus The gripping belts are positioned so that the product is positively and continuously gripped by at least one opposed pair or belts as the product traverses the apparatus 10**.

Each folding mechanism 30 includes a pair of twisted belts **36*a*, 36*b*, carried on pulleys 40 41*a*, 41*b* and 42. These belts function in the manner of the conical roller sets described in U.S. Pat. No. 4,588,393. They rotate laterally projecting portion 18*a* and 18*b* (FIG. 6) of the product 18 about the running reference edge. At least one of the pulleys carrying each belt 86*a*, 36*b* is driven at the same speed as at least one of the pulleys 34 so that all of the belts contacting the paper products are moving at substantially the same speed as the product. As shown, the pulleys 40 and 42 have a horizontal axis of rotation and the pulleys 41*a* and 41*b* have a vertical axis of rotation. As a result, the belt 36*a* rotates the product portion 18*a* through a 90° upward rotation. A first section of the belt 36*b* then rotates the portion 18*a* through a further 90° rotation to complete the first fold along a fold line 18*c* defined by the running reference edge of the gripping belts. The product is then in the condition designated as 18' in FIG. 6. A second section 36*b*" of the belt cooperates with an underlying gripping belt 32*b* to crease the folded product, typically with the aid of spring-loaded idlers 43 (FIG. 1). A corresponding, mirror-image set of belts and pulleys mounted on the frame members 20,24 of the folding station 14 then create a second fold of the laterally projecting paper portion 18*b* about a second fold line 18*d* that is laterally spaced from the first fold line 18*c* by a distance D (FIG. 6). The folding station 14 also rotates the portion 18*b* through 180° in two steps defined by the twisted belt 36*a* and 36** bacting in cooperation with a running edge defined by one or an opposed pair of the gripping belts.

Figure 8:
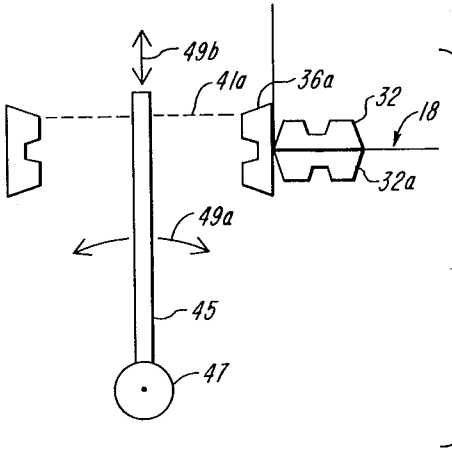
FIG. 8 is a detailed view in section showing the adjustability of the position of the folding belts to produce a sharply creased product.
Figure 7:
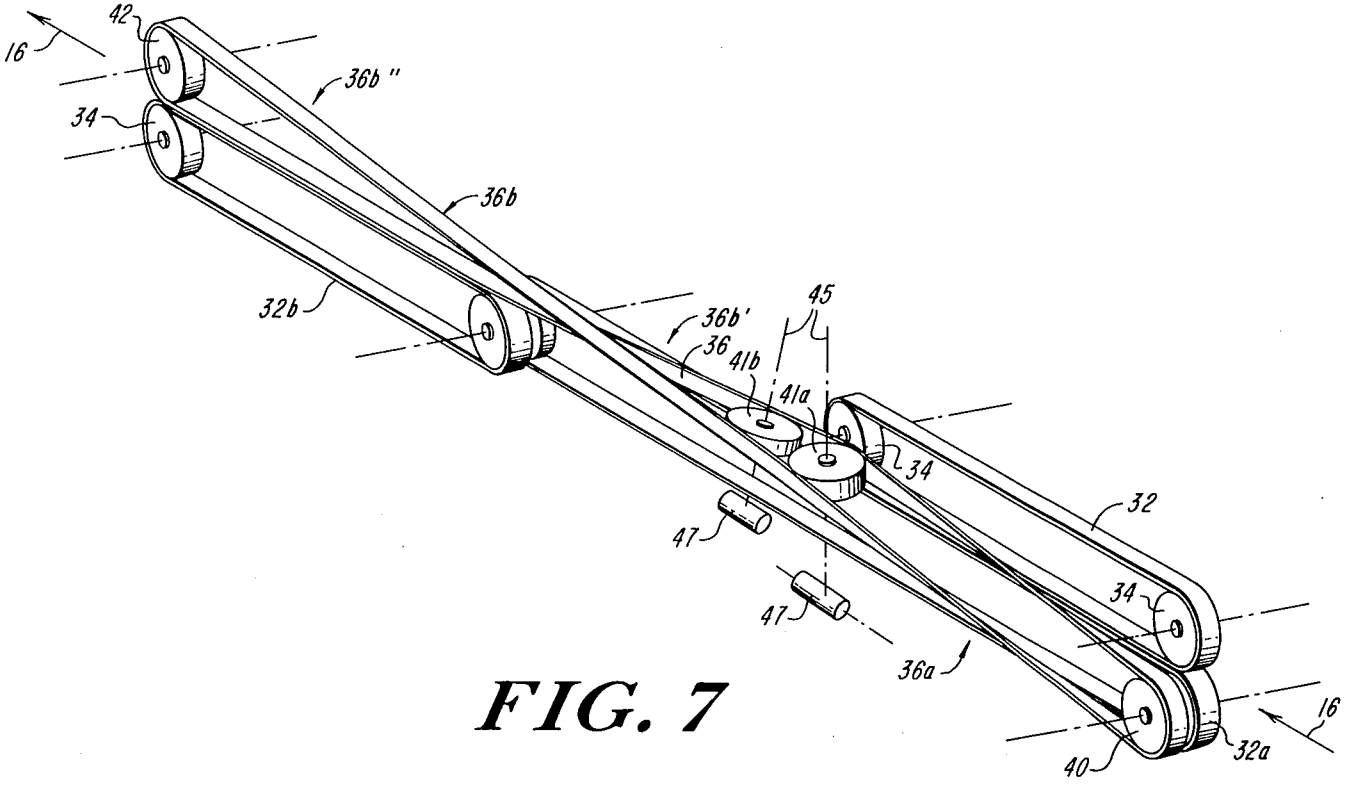
FIG. 7 is a perspective view of the gripping and folding belts used in the downstream station shown in FIG. 1.

As is best seen in FIGS. 7 and 8, the pulleys **41*a* and 41*b* are each mounted on a generally vertically oriented shaft 45 which in turn is mounted on a pivotedly mounted member 47 having an axis of rotation generally aligned with the product flow path 16. Because of this pivotal mounting, the lateral position of the belts 36*a*, 36*b* with respect to the fold line at the edge of the gripping belts can be adjusted as indicated by arrows 49*a*. The pulleys 41*a* and 41*b* are also adjustably positioned vertically on the associated shafts 45 as indicated by the arrow 49*b*. These lateral and vertical adjustments allow good control over the definition of the fold line at the end of its rotation and ensure that the belts 86a, 86b are positioned close to the running edge of the gripping belts to crease the 90° folded product. In particular, these adjustments can eliminate a tendency of the paper to form a U-shaped fold or otherwise not produce a crisp, right angle fold, as shown in FIG. 8**.

Although not shown in these figures, the folding stations can utilize additional creasing belts, spring loaded idlers, jam detection and clearing mechanisms, forming plates and guide bars, all as illustrated and described in the aforementioned U.S. Pat. No. 4,588,398. Also, while the invention is shown with too twisting belts 36a, 36b, it is possible to perform the function of these belts with one belt to perform each of the functions described above. While this arrangement involves fewer components, it sacrifices control over the position and speed of the twisting belt relative to the product and other belts.

A principal object of the present invention is that the folding apparatus is formed of at least two stations 12 and 14 that are physically separated by a gap 44 between the frame members 20 and 22 of the stations 12 and 14 and are supported independently of one another. A further principal feature of the present invention is that at least one, and preferably both, of the stations 12,14 has a mechanism 50 that translates the associated station 12 or 14 as a hole along a direction 52 that is perpendicular to the path 16 in the horizontal plane. A translation of one or both of the stations 12 and 14 along the direction 52 moves the location of the fold line 18c or 18d, or both, With respect to the paper 18 (assuming that the in-feed registration for the stream of products remains fixed). This provides a highly simple, convenient and accurate way of varying the distance D between the fold lines 18c and 18d to produce a different sized final, double-folded product, or to accommodate different size products.

The mechanism 50 is best understood with reference to FIGS. 2–5. The stands 26, 28 include legs 26a, 26a and 28a, 28a, respectively, terminating in slide blocks 54 secured in guides 56 mounted on a base member 58. The guides 56 have side walls 56a and flanges 56b that secure the blocks 54 and allow them to move only in the direction 52. The friction between the blocks 54,54 and the base 58, and to a lesser extent the guides 56, assists in securing the station in a selected lateral location along the direction 52. A shaft 60 extends between the stands 26, 28 of each station and is rotatably mounted in a downwardly projecting portion 26c, 28c of each stand. The shaft 60 carries pinions 62,62 fixed of the shaft that each engage a mating linear rack 64 secured on the base 58. Rotation of the shaft 60 is therefore translated into a simultaneous and equal linear movement of the stands 26, 28 with respect to the bases 58,58 through the interaction of the pinions and racks. A hand wheel 66 rotates a gear 68 which is connected to a gear 70 fixed on the shaft 60 through a belt or chain 72. Rotation of the crank 66 therefore produces the desired simultaneous and equal lateral adjustment in the position of the stands with respect to the product flow path which in turn provides an ability to vary the inter-fold spacing D.

Another feature of this invention is that each station is independently angularly adjustable in a horizontal plane with respect to the paper feed path 16. This adjustability can be introduced with a variety of mechanical arrangements, but a preferred arrangement, which has proven effective and which has a favorable cost of manufacture, includes a pivot pin 80, secured in the floor 82 (FIG. 4) which rotates in a hole formed in a flange 84 secured to one of the base members 58. The pin 80 is located so that it is generally in vertical alignment with the product flow path 16. The other base member carries a screw 86 rotatably mounted in the bearing pieces 88,88 secured to the base member and rotatable using a hand wheel 90. The screw threads in a follower block 92 secured to the floor (FIG. 5 . Each base member mounts a pair of wheels 93,93 which allow a lateral rolling movement of the base members, and therefore the station supported on the base members in the circumferential direction 94, which is generally perpendicular to the feed path and also in a horizontal plane.

Rotation of the hand wheel 90 rotates the screw 86 which causes a movement of the associated base member along the direction 92 with respect to the stationary follower block. The station as a whole pivots about the pin 80, which is also stationary. The adjusting movement causes a corresponding, but smaller, movement of the base member adjacent the pin 80. This skew adjustment corrects variations in the "squareness" of the fold made by the station. In practice, due perhaps to variations in belt speeds, nip pressures, or variations in the resilience of the belts, the folded portions 18a and 18b will not precisely overlie the central paper portions onto which they are folded. To correct this problem, with the present invention one rotates the entire station until the folded paper product is square. (Alignment problems introduced by minor variations in the belt speeds on opposite sides of the paper are reduced by driving only one side of the paper at any given time.)

There has been described a high-speed folding apparatus for paper products that are not pre-creased which can operate on-line with a printing press, or off-line, and which can vary the spacing between a pair of fold lines to provide great flexibility in the size of the double or C-folded end-product and in the size of the paper product which can be accepted by the apparatus. There has also been described a folding apparatus which can make adjustments in the squareness of the folds. Moreover, these adjustments can be made simply by manual adjustments and they are highly precise and reliable. The present invention also provides great flexibility in the design of a folding line since any number of stations, which can perform a variety of folding operations, can be assembled into a single composite apparatus. For example, by interchanging the position of the two folding stations along the product flow path the left or righthand projecting product portion ("panel") can be folded first to produce a C-folded product where either the first page or a mailing label on the last page is immediately visible. Further, with the lateral adjustment capability of the present invention, one can use a two station apparatus described above to either C-fold a product, or one can remove one of the stations from the flow path (or disengage its folding mechanisms) and readjust the portion of the remaining station to half fold products into a mail insert size.

While this invention has been described with reference to its preferred embodiments, it will be understood that variations and modifications will occur to those skilled in the art. For example, if the invention is not used with freshly printed material, one can use a different arrangement than described above for producing the folds. It is also possible to produce products purposely folded along non-parallel lines or to produce less than two or more than too folds in each product. These and all such variations and modifications are intended to fall within the scope of the appended claims.

What is claimed is:

1. An apparatus for folding a non-creased sheet-like paper product having at least one ply along at least two generally parallel lines that extend along a first direction defined by a straight line path of the product through the apparatus, the improvement comprising means for adjusting the spacing between the fold lines including;

a first station for folding the product along a first one of the fold lines and having a support, a frame and means mounted on the frame for (i) propelling the product through the station along said path and (ii) folding a first laterally projecting portion of the product along said first one of the fold lines;

a second station for folding the product along a second one of the fold lines, said second station being aligned along said first direction with said first station and having a support, a frame, and means mounted on the frame for (i) propelling the product through the station along said path and (ii) folding a second laterally projecting portion of the product along said second one of the fold lines; and means for translating said first and second stations relative to one another along a second direction perpendicular to said first direction.

2. An adjustment means of claim 1 wherein said translating means comprises means for mounting said supports for movement in said second direction, and means for driving said supports along said second direction.

3. The adjustment means of claim 2 wherein said supports comprise at least two upright members and said drive means comprises a mechanical arrangement for driving said upright members in unison.

4. The adjustment means of claim 3 wherein said mechanical arrangements includes a drive shaft aligned along said first direction, pinions carried on said drive shaft, racks associated with each of said supports and adapted to engage an associated one of said pinions, and means for rotating said shaft.

5. The adjustment means of claim 1 further comprising means for independently adjusting the angular orientation of said first and second supports with respect to said first direction to adjust the squareness of said folds in the product.

6. An adjustment means of claim 5 wherein said angular orientation adjustment means comprises mechanical means for translating one end of said support generally along said second direction about a vertical axis of rotation that is generally aligned with said path.

7. The adjustment means of claims 1 or 6 wherein said folding means includes at least one pair of opposed belts, each of said belts having a substantially flat surface that grips said product with substantially no relative motion between the belts and the product, a continuous longitudinal groove in the opposite surface, and a side surface that together with the flat, product-engaging surface defines an edge moving at the same speed as the product which defines the location of the fold, means urging the opposed belts to grip the product, and means for folding said projecting product portions against said reference edge where the folding occurs as an incrementally increasing rotation of the product portion in coordination with the advance of said product along said first direction, said folding means having substantially no relative motion between itself and said product.

* * * * *